US008967948B2

(12) United States Patent
Hashima et al.

(10) Patent No.: US 8,967,948 B2
(45) Date of Patent: Mar. 3, 2015

(54) UNIAXIAL ECCENTRIC SCREW PUMP

(71) Applicants: Takashi Hashima, Hyogo (JP); Masaki Ogawa, Hyogo (JP)

(72) Inventors: Takashi Hashima, Hyogo (JP); Masaki Ogawa, Hyogo (JP)

(73) Assignees: NETZSCH Pumpen & Systeme GmbH (DE); Heishin Ltd. (JP)

( * ) Notice: Subject to any disclaimer, the term of this patent is extended or adjusted under 35 U.S.C. 154(b) by 0 days.

(21) Appl. No.: 13/708,648

(22) Filed: Dec. 7, 2012

(65) Prior Publication Data

US 2013/0108412 A1 May 2, 2013

Related U.S. Application Data

(63) Continuation of application No. PCT/JP2011/061711, filed on May 23, 2011.

(30) Foreign Application Priority Data

Jun. 7, 2010 (JP) ..... 2010-130396

(51) Int. Cl.
*F04D 3/02* (2006.01)
*F04C 2/107* (2006.01)

(52) U.S. Cl.
CPC ..... *F04D 3/02* (2013.01); *F04C 2/1075* (2013.01); *F04C 2230/70* (2013.01)
USPC ..... 415/73

(58) Field of Classification Search
USPC ..... 415/71, 72, 73, 26, 215.1
See application file for complete search history.

(56) References Cited

U.S. PATENT DOCUMENTS

| | | | | |
|---|---|---|---|---|
| 7,946,828 | B2 * | 5/2011 | Ovsthus et al. | 417/68 |
| 2007/0059191 | A1 * | 3/2007 | Kreidl et al. | 418/45 |
| 2007/0128062 | A1 | 6/2007 | Frisch et al. | |
| 2007/0183892 | A1 * | 8/2007 | Sorokes | 415/214.1 |

FOREIGN PATENT DOCUMENTS

| | | | |
|---|---|---|---|
| CA | 2575565 | C | 2/2006 |
| CA | 2557691 | C | 3/2007 |
| CN | 1932289 | A | 3/2007 |
| CN | 1993551 | A | 7/2007 |

(Continued)

OTHER PUBLICATIONS

International Search Report Application No. PCT/JP2011/061711 Completed: Aug. 5, 2011; Aug. 16, 2011 2 pages.

*Primary Examiner* — Nathaniel Wiehe
*Assistant Examiner* — Jeffrey A Brownson
(74) *Attorney, Agent, or Firm* — St. Onge Steward Johnston & Reens LLC

(57) ABSTRACT

A uniaxial eccentric screw pump enabling a stator to be easily separated into an outer cylinder and a lining member, and being capable of solving problems such as a positional shift and deformation of the lining member, and an occurrence of uneven wear and an unstable discharge amount associated with the positional shift and deformation. The stator includes a liner portion having a cylindrical shape and being integrally formed so as to have an inner peripheral surface of an internal thread type and an outer cylinder portion. The liner portion includes, at both end portions thereof, flange portions protruding radially outward, and an outer cylinder mounting portion is provided between the flange portions. The outer cylinder portion is mounted in a non-bonded state on the outer cylinder mounting portion, and both end portions of the outer cylinder portion abut on the flange portions, respectively.

15 Claims, 7 Drawing Sheets

(56) References Cited

FOREIGN PATENT DOCUMENTS

| | | | | |
|---|---|---|---|---|
| DE | 3503604 | A1 | | 8/1986 |
| DE | 102005042559 | A1 | | 3/2007 |
| DE | 112005002515 | A5 | | 7/2007 |
| EP | 1762726 | A2 | | 3/2007 |
| JP | 48048206 | U | | 6/1973 |
| JP | 52159409 | U | | 12/1977 |
| JP | 56118987 | U | | 9/1981 |
| JP | 2005076760 | A | | 3/2005 |
| JP | 2005344587 | A | | 12/2005 |
| JP | 2007071208 | A | | 3/2007 |
| JP | 2007303412 | A | * | 11/2007 |
| JP | 2008509313 | A | | 3/2008 |
| JP | 2010168991 | A | | 8/2010 |
| KR | 20070039572 | A | | 4/2007 |
| WO | 2006015574 | A1 | | 2/2006 |
| WO | 2010084537 | A1 | | 7/2010 |

* cited by examiner

UNIAXIAL ECCENTRIC SCREW PUMP

FIELD OF THE INVENTION

The present invention relates to a uniaxial eccentric screw pump including a stator capable of being divided into an outer cylinder portion and a lining portion.

BACKGROUND OF THE INVENTION

Conventionally, prior art systems such as JP 2005-344587 A provide a pump called a uniaxial eccentric screw pump having structure in which a rotor formed into an external thread shape is inserted in an inside of a stator having an inner peripheral surface formed into an internal thread shape. Many stators adopted in the pump have structure in which a lining member made of rubber, a resin, or the like is inserted in an inside of a metal outer cylinder. In the stators adopted in a prior art systems, the outer cylinder and the lining member are fixed to each other through bonding or the like, which prevents positional shifts of the outer cylinder and the lining member and the positional shift of the lining member.

SUMMARY OF THE INVENTION

In recent years, consideration for environmental issues is required, and also the uniaxial eccentric screw pump is expected to have structure enabling the outer cylinder and the lining member constituting the above-mentioned stator to be easily separated and recovered. However, in a case where the outer cylinder and the lining member are fixed to each other through bonding as in the conventional technology, there is a problem in that considerable time and effort are required in order to separate the outer cylinder and the lining member from each other. Meanwhile, when adopting, in consideration of time and effort for separating and recovering, a configuration in which the outer cylinder is mounted simply in a non-bonded state on the lining member, there arises a problem such as the positional shift of the lining member in an axial direction and in a peripheral direction or deformation thereof, and hence there may be a variety of fears involving stabilizing an operation state of the uniaxial eccentric screw pump. Specifically, due to expansion and shrinkage of the lining member in the axial direction, a diameter of a through-hole formed in an inside of the lining member varies from part to part, and hence there may arise a problem such as an occurrence of uneven wear, or an unstable discharge amount.

Therefore, it is an object of the present invention to provide a uniaxial eccentric screw pump enabling a stator to be easily separated into an outer cylinder and a lining member, and being capable of solving problems such as a positional shift and deformation of the lining member, and an occurrence of uneven wear and an unstable discharge amount associated with the positional shift and deformation.

In order to solve the above-mentioned problems, according to an exemplary embodiment of the present invention, there is provided a uniaxial eccentric screw pump, including: a rotor of an external thread type; and a stator enabling the rotor to be inserted therethrough, the stator including: a liner portion having a cylindrical shape and being integrally formed so as to have an inner peripheral surface of an internal thread type; and an outer cylinder portion mounted in a pressed state on an outer periphery of the liner portion. In the uniaxial eccentric screw pump according to the exemplary embodiment of the present invention, the liner portion includes, at both end portions thereof, collar portions protruding radially outward. Further, the outer cylinder portion is arranged between the collar portions, and end portions of the outer cylinder portion abut on the collar portions, respectively.

In the stator adopted in the uniaxial eccentric screw pump according to the exemplary embodiment of the present invention, the outer cylinder portion is mounted in the pressed state on the liner portion, and hence the liner portion and the outer cylinder portion are integrated with each other without using an adhesive. Therefore, the uniaxial eccentric screw pump according to the exemplary embodiment of the present invention enables the stator to be easily separated into the liner portion and the outer cylinder portion, and enables the stator to be recovered and recycled.

The uniaxial eccentric screw pump according to the exemplary embodiment of the present invention has the structure in which the outer cylinder portion is arranged between the collar portions provided at both the end portions of the liner portion, respectively, and in which the end portions of the outer cylinder portion abut on the collar portions, respectively. Therefore, the outer cylinder portion functions as a support for preventing the liner portion from shrinking in an axial direction, which can keep an inner diameter of the liner portion substantially uniform. Thus, it is possible to avoid uneven wear of the liner portion, and to stabilize a discharge amount.

According to an exemplary embodiment of the present invention, there is also provided a uniaxial eccentric screw pump, including: a rotor of an external thread type; and a stator enabling the rotor to be inserted there through, the stator including: a liner portion having a cylindrical shape and being integrally formed so as to have an inner peripheral surface of an internal thread type; and an outer cylinder portion mounted in a non-bonded state on the liner portion to cover an outer periphery of the liner portion. In the uniaxial eccentric screw pump according to the exemplary embodiment of the present invention, the liner portion includes, at both end portions thereof, collar portions protruding radially outward. Further, the outer cylinder portion is arranged between the collar portions, and end portions of the outer cylinder portion abut on the collar portions, respectively.

In the stator adopted in the uniaxial eccentric screw pump according to the exemplary embodiment of the present invention, the outer cylinder portion is mounted in the non-bonded state on the liner portion, and hence it is possible to easily separate and recover the outer cylinder portion and the liner portion. Further, the uniaxial eccentric screw pump according to the exemplary embodiment of the present invention has the structure in which the outer cylinder portion is arranged between the collar portions provided at both the end portions of the liner portion, respectively, and in which the end portions of the outer cylinder portion abut on the collar portions, respectively, and thus can prevent the liner portion from shrinking in the axial direction. This can keep the inner diameter of the liner portion substantially uniform at any part. Thus, it is possible to avoid the uneven wear of the liner portion, and to stabilize the discharge amount.

In the uniaxial eccentric screw pump according to the exemplary embodiment of the present invention, it is preferred that the outer cylinder portion is capable of being divided into a plurality of outer cylinder components in a peripheral direction thereof.

With this configuration, it is possible to more easily perform work of mounting/dismounting the outer cylinder portion to/from the liner portion. Note that, in a case where the outer cylinder portion is formed of the plurality of outer cylinder components, integrating the outer cylinder components with each other through clamp joining enables the work of mounting/dismounting the outer cylinder portion to be even more easily performed.

The above-mentioned uniaxial eccentric screw pump according to the exemplary embodiment of the present invention may further include an end stud arranged on one end side of the stator. The end stud and an end portion of a pump casing connecting to another end side of the stator are coupled and fastened by a screw rod so that the stator is integrally coupled to the pump casing together with the end stud. The end portions of the outer cylinder portion abut on the end stud and the end portion of the pump casing, respectively.

In a case of adopting this configuration, a fastening force (sandwiching force), which acts between the end stud and the pump casing through coupling and fastening by the screw rod, acts more preferentially on the outer cylinder portion than on the liner portion, and hence it is possible to prevent the liner portion from being compressed by the fastening force in the axial direction. Thus, the uniaxial eccentric screw pump according to the exemplary embodiment of the present invention can further keep the inner diameter of the liner portion substantially uniform at any part. Therefore, according to the exemplary embodiment of the present invention, it is possible to avoid the uneven wear of the liner portion, and to stabilize the discharge amount.

Further, the uniaxial eccentric screw pump according to the exemplary embodiment of the present invention is preferred to further include a fitting portion enabling at least one of the collar portions to be fitted thereto, the fitting portion being provided at the end stud and/or the end portion of the pump casing. It is preferred that, at the fitting portion, the at least one of the collar portions is sandwiched between the end stud and the outer cylinder portion and/or between the pump casing and the outer cylinder portion.

This configuration can more reliably prevent a positional shift of the liner portion, and contribute to stabilization of an operation state of the uniaxial eccentric screw pump.

In the uniaxial eccentric screw pump according to the exemplary embodiment of the present invention, the liner portion may have a polygonal outward shape.

With this configuration, it is possible to prevent the positional shift of the liner portion in a peripheral direction, and to further stabilize the operation state of the uniaxial eccentric screw pump.

Further, in the uniaxial eccentric screw pump according to the exemplary embodiment of the present invention, it is preferred that the outer cylinder portion be bent into a shape conforming to the outward shape of the liner portion.

With this configuration, it is possible to more reliably prevent the positional shift of the liner portion in the peripheral direction, and to even further stabilize the operation state of the uniaxial eccentric screw pump.

The uniaxial eccentric screw pump according to the exemplary embodiment of the present invention may further include a protrusion provided on an inner peripheral side of the outer cylinder portion. The protrusion may be held in press-contact with an outer peripheral surface of the liner portion.

With this configuration, the protrusion is engaged on the outer peripheral surface of the liner portion by being pressed, and hence the positional shift of the liner portion can be reliably prevented. Thus, this configuration is effective particularly in a case where there is a fear of the positional shift of the liner portion as in a case where the outward shape of the liner portion is cylindrical.

According to the present invention, it is possible to provide the uniaxial eccentric screw pump enabling the stator to be easily separated into the outer cylinder and the lining member, and being capable of solving the problems such as the positional shift and deformation of the lining member, and the occurrence of uneven wear and the unstable discharge amount associated with the positional shift and deformation.

BRIEF DESCRIPTION OF THE DRAWINGS

FIG. 4(*a*) is a front view of the stator;

FIG. 4(*b*) is a side view thereof;

FIG. 4(*c*) is a cross-sectional view taken along the line A-A of FIG. 4(*a*);

FIG. 5(*a*) is a front view of the liner portion;

FIG. 5(*b*) is a side view thereof;

FIG. 5(*c*) is a cross-sectional view taken along the line C-C of FIG. 5(*b*);

FIG. 5(*d*) is a cross-sectional view taken along the line B-B of FIG. 5(*a*);

DETAILED DESCRIPTION OF THE INVENTION

Figure 1:
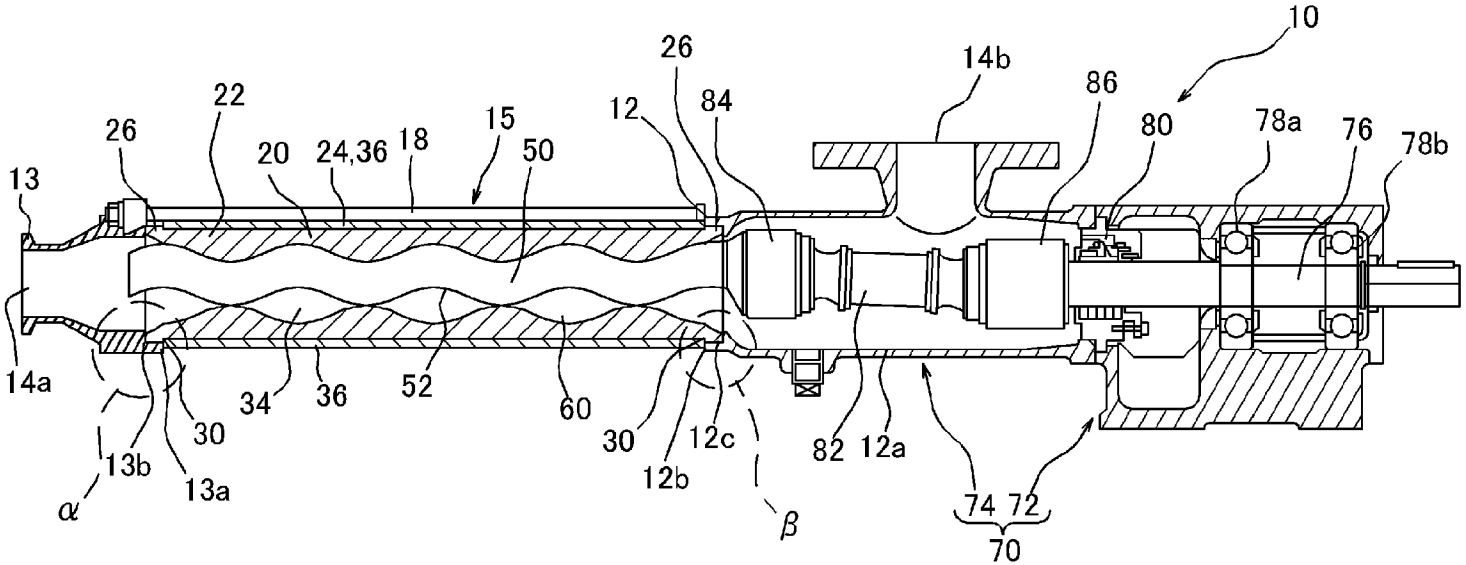
FIG. 1 is a cross-sectional view illustrating a uniaxial eccentric screw pump according to an embodiment of the present invention.

Next, a uniaxial eccentric screw pump 10 according to an embodiment of the present invention is described in detail with reference to the drawings. The uniaxial eccentric screw pump 10 is a so-called rotary positive displacement pump, and as illustrated in FIG. 1, includes a stator 20, a rotor 50, and a power transmission mechanism 70. Further, the uniaxial eccentric screw pump 10 includes a cylindrical pump casing 12 made of a metal and an end stud 13, and has structure in which the cylindrical pump casing 12 and the end stud 13 are connected to and integrated with each other through the intermediation of a stay bolt 18 (screw rod). In the uniaxial eccentric screw pump 10, a first opening 14*a* is formed in the end stud 13, and a second opening 14*b* is formed in an outer peripheral part of the pump casing 12. The first opening 14*a* is a through-hole formed through the uniaxial eccentric screw pump 10 in its axial direction. The second opening 14*b* is communicated to an internal space of the pump casing 12 at an intermediate portion 12*a* that is situated in an intermediate part of the pump casing 12 in a longitudinal direction.

The first opening 14*a* and the second opening 14*b* function as a suction port and a discharge port of the uniaxial eccentric screw pump 10, respectively. More specifically, the uniaxial eccentric screw pump 10 according to this embodiment can transfer fluid under pressure by rotating the rotor 50 in a forward direction so that the first opening 14*a* functions as the discharge port and the second opening 14*b* functions as the suction port. Conversely, the uniaxial eccentric screw pump 10 can transfer the fluid under pressure by rotating the rotor 50 in a reverse direction so that the first opening 14*a* functions as the suction port and the second opening 14*b* functions as the discharge port.

Figure 2:
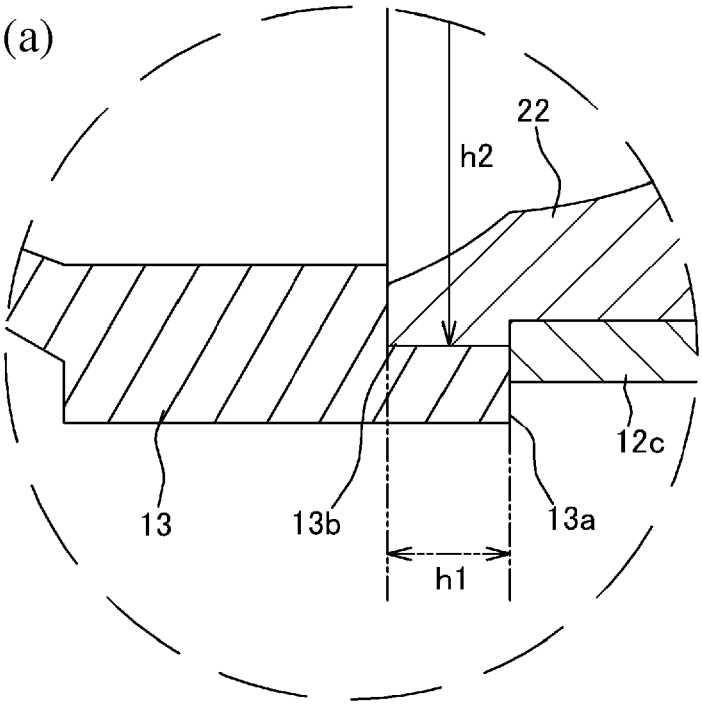
FIG. 2(*a*) is an enlarged view of a portion α of FIG. 1, and FIG. 2(*b*) is an enlarged view of a portion β of FIG. 1.
Figure 2:
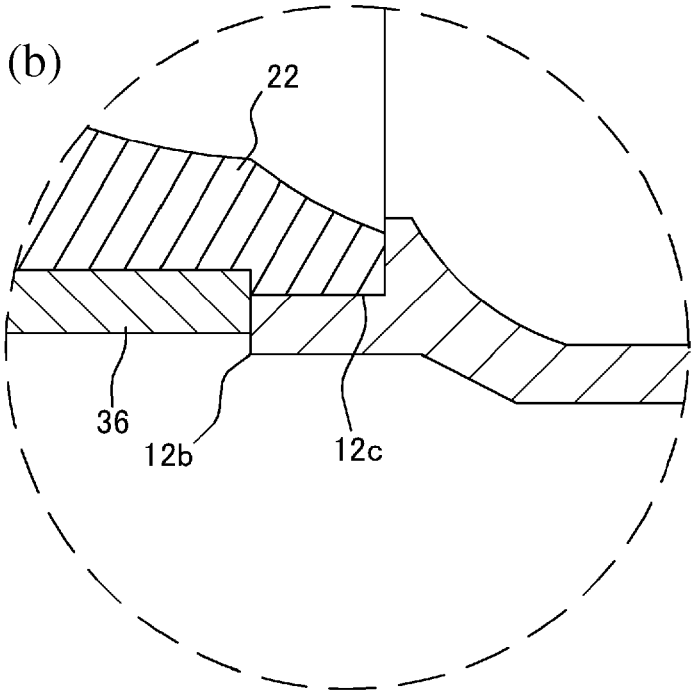

As illustrated in FIG. 1 and FIGS. 2, at a part (end portion 12*b*) facing the end stud 13 side in a state in which the uniaxial eccentric screw pump 10 is assembled, the pump casing 12 includes a fitting portion 12*c* formed to have a stepped cross-sectional shape. Further, at a part (end portion 13*a*) facing the pump casing 12 side in the state in which the uniaxial eccentric screw pump 10 is assembled, the end stud 13 includes a fitting portion 13*b* formed to have a stepped cross-sectional shape. Each of the fitting portions 12*c*, 13*b* is provided so as to fit thereto a flange portion 26 of the stator 20, which is described in detail later. A width h1 (axial length) of the fitting portion 12*c*, 13*b* is substantially equal to a thickness (axial length) of the flange portion 26, and an opening diameter h2 of a part provided with the fitting portion 12*c*, 13*b* is substantially equal to an outer diameter of the flange portion 26.

The uniaxial eccentric screw pump 10 includes a stator fixing portion 15 for fixing the stator 20 between the pump casing 12 and the end stud 13. In the uniaxial eccentric screw pump 10, through mounting of the stay bolt 18 in a state in which the stator 20 is arranged on the stator fixing portion 15, the pump casing 12 and the end stud 13 are coupled to each other through the intermediation of the stator 20, thereby forming a series of flow passages connecting between the first opening 14*a* and the second opening 14*b* described above.

Figure 3:
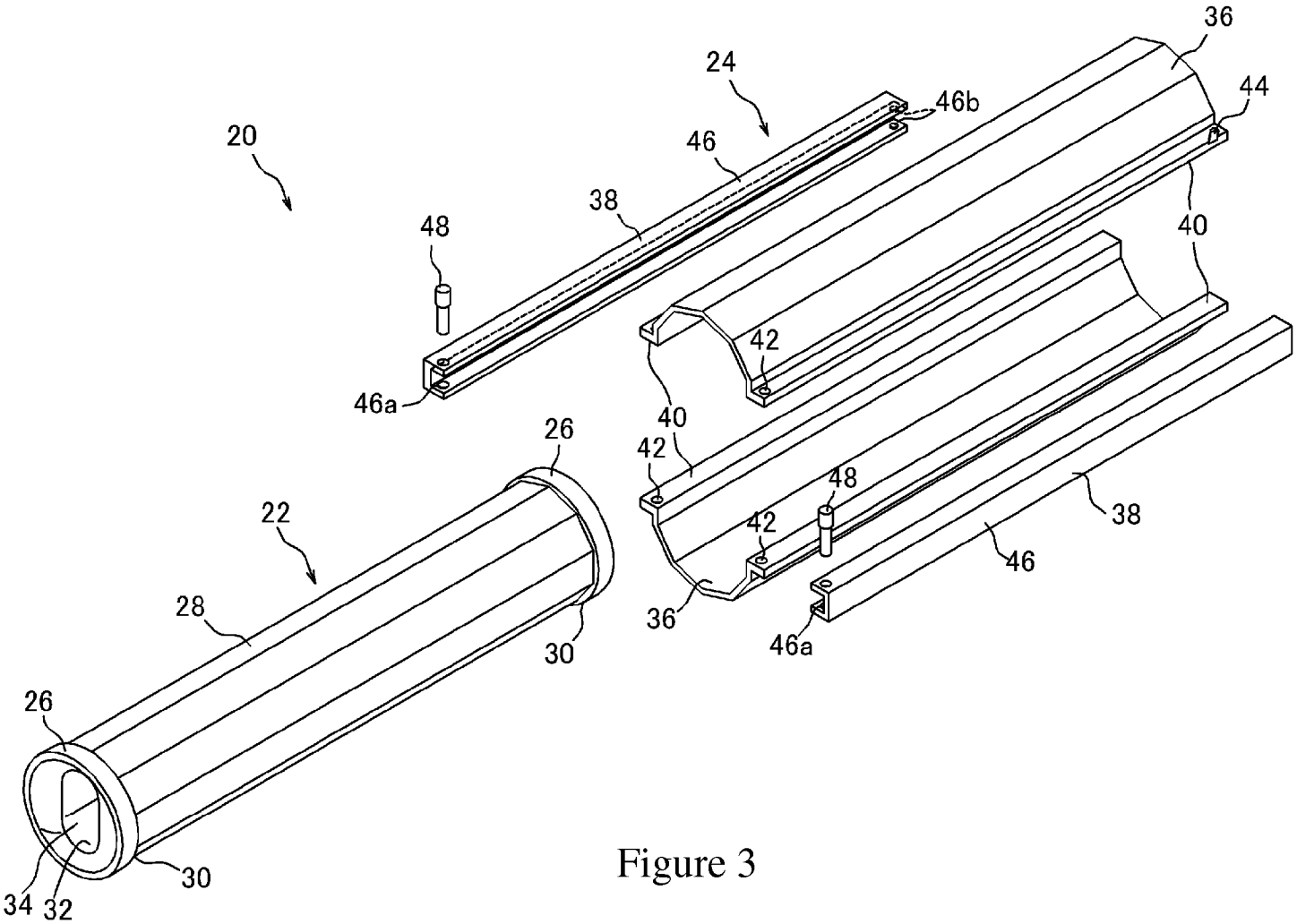
FIG. 3 is an exploded perspective view of a stator.
Figure 4:
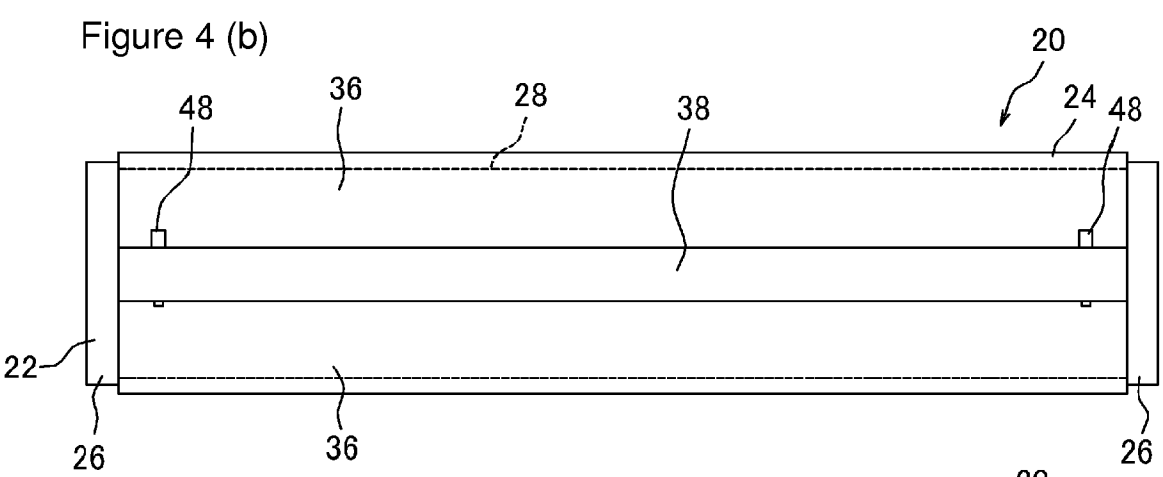
FIG. 4 are views illustrating the stator adopted in the uniaxial eccentric screw pump illustrated in FIG. 1.
Figure 4:
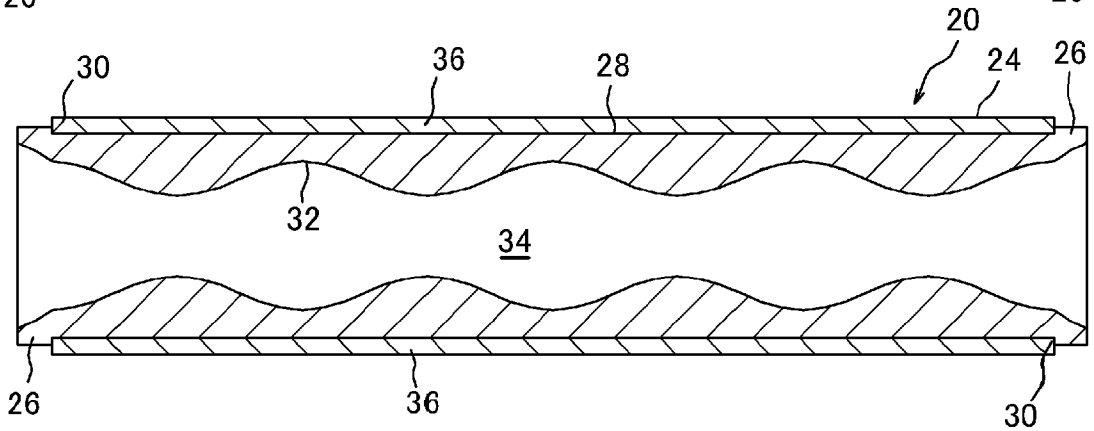
Figure 4:
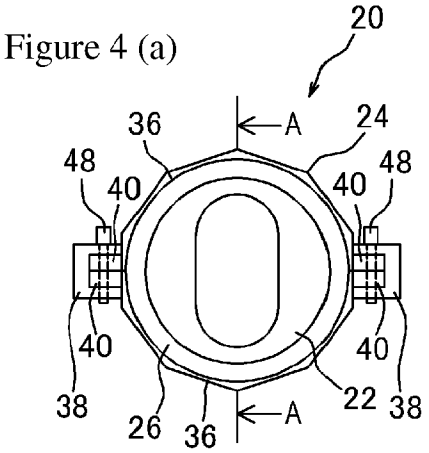
Figure 5:
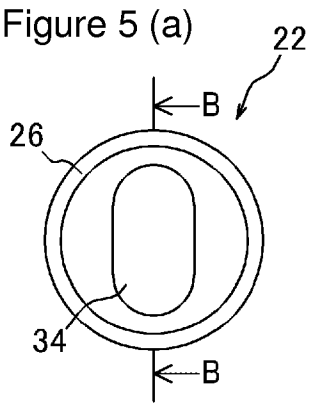
FIG. 5 are views illustrating a liner portion adopted in the stator illustrated in FIG. 3.
Figure 5:
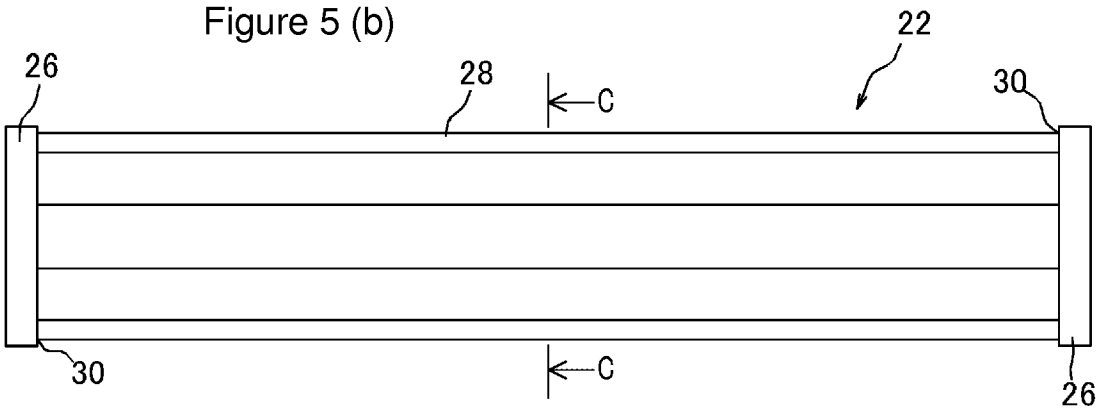
Figure 5:
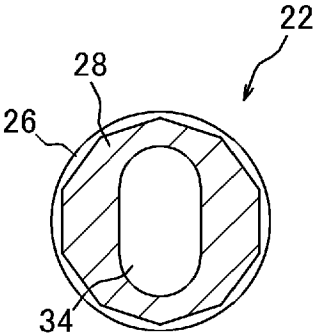
Figure 5:
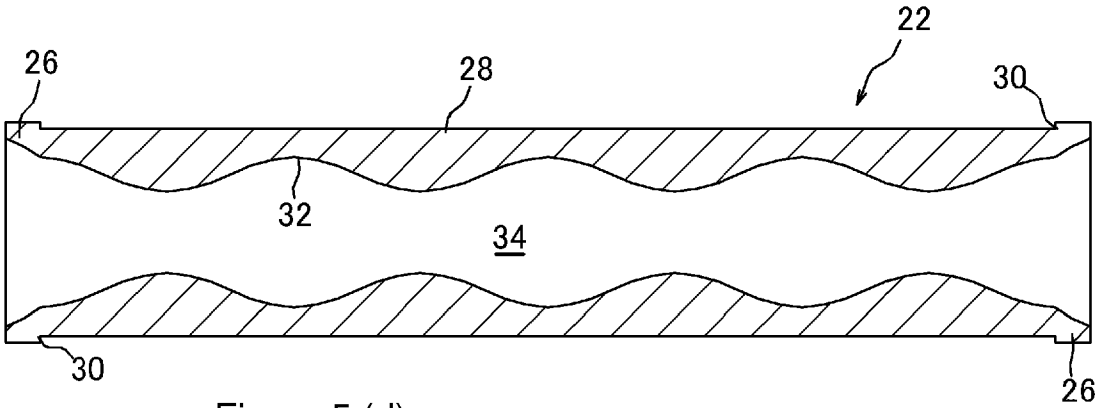

The stator 20 is the most characteristic part in the uniaxial eccentric screw pump 10. As illustrated in FIG. 1, FIG. 3, and FIGS. 4, the stator 20 is divided roughly into a liner portion 22 and an outer cylinder portion 24. The liner portion 22 is integrally formed of a resin, an elastic material typified by rubber, or the like. A material of the liner portion 22 is selected as appropriate depending on a kind, a property, and the like of the fluid as an object to be conveyed, which is to be transferred using the uniaxial eccentric screw pump 10.

The liner portion 22 is a cylinder which includes, at both axial end portions, the flange portions 26, 26(collar portions) protruding radially outward, and includes an outer cylinder mounting portion 28 for mounting thereon the outer cylinder portion 24 between the flange portions 26, 26. The liner portion 22 is a member obtained by integrally forming the flange portions 26, 26 and the outer cylinder mounting portion 28, and includes a step 30 at a boundary part between each of the flange portions 26, 26 and the outer cylinder mounting portion 28. An outward shape (cross-sectional shape) of each of the flange portions 26, 26 is substantially circular, and an outward shape (cross-section I shape) of the outer cylinder mounting portion 28 is polygonal (substantially regular decagonal in this embodiment). Further, as described above, the thickness of each of the flange portions 26, 26 is substantially equal to the width h1 of the fitting portion 12*c* provided at the end portion 12*b* of the pump casing 12 and the width h1 of the fitting portion 13*b* provided at the end portion 13*a* of the end stud 13. The outer diameter of each of the flange portions 26, 26 is substantially equal to the opening diameter h2 of the fit ting portion 12*c* provided at the end portion 12*b* of the pump casing 12 and the opening diameter h2 of the fitting portion 13*b* provided at the end portion 13*a* of the end stud 13.

In an inner peripheral surface 32 of the liner portion 22, a multi-stage internal thread shape is formed. More specifically, in an inside of the liner portion 22, there is formed a through-hole 34 extending along the longitudinal direction of the liner portion 22, threaded through at a predetermined pitch, and having an internal thread shape. The through-hole 34 is formed to have a substantially elliptical cross-sectional shape (opening shape) in cross-sectional view taken from any position in the longitudinal direction of the liner portion 22.

As illustrated in FIG. 3 and FIGS. 4, the outer cylinder portion 24 covers an outer periphery of the above-mentioned liner portion 22 and is mounted in a non-bonded state over the outer cylinder mounting portion 28 of the liner portion 22. Specifically, the outer cylinder portion 24 is mounted in a pressed state on the outer periphery of the liner portion 22, integrated with the liner portion 22 without using an adhesive, and positioned both in a peripheral direction and in the axial direction.

The outer cylinder portion 24 includes a plurality of (two in this embodiment) outer cylinder components 36, 36 and clamps 38, 38. Each of the outer cylinder components 36, 36 is a metal member covering substantially a half of a peripheral region of the outer cylinder mounting portion 28 of the liner portion 22, and is curved (bent) into a shape conforming to the outer cylinder mounting portion 28. Therefore, through mounting of the outer cylinder component 36 on the outer cylinder mounting portion 28, the outer cylinder component 36 is prevented from turning in the peripheral direction. Further, as illustrated in FIG. 4(*c*), the thickness of the outer cylinder component 36 is larger than the height of the step 30 formed between the flange portion 26 and the outer cylinder mounting portion 28 in the liner portion 22. Therefore, when mounting the outer cylinder component 36 on the outer cylinder mounting portion 28, as illustrated in FIG. 1 and FIGS. 4, the outer cylinder component 36 projects radially outward of the liner portion 22 with respect to the flange portion 26.

Further, the length of the outer cylinder component 36 is substantially equal to the length of the outer cylinder mounting portion 28. Therefore, when mounting the outer cylinder component 36 on the outer cylinder mounting portion 28, as illustrated in FIG. 1, FIGS. 2, and FIGS. 4, both end portions of the outer cylinder component 36 abut on the flange portions 26, 26 at the parts of the liner portion 22 at which the steps 30 are formed. Therefore, in a case where compressive stress acts in the axial direction (longitudinal direction) in a state in which the outer cylinder components 36 are mounted on the liner portion 22, the outer cylinder portion 24 receives the stress by the outer cylinder components 36, and thus can prevent compressive deformation of the liner portion 22 and deformation of the through-hole 34 formed in the liner portion.

At both peripheral end portions of the outer cylinder portion 24, clamped portions 40, 40 are formed so as to extend in the longitudinal direction. On one end side of the clamped portions 40, 40, pin insertion holes 42, 42 are provided, and engagement grooves 44, 44 are formed on the other end side thereof. The pin insertion holes 42, 42 and the engagement grooves 44, 44 are used for mounting the clamps 38, 38 which are described in detail later. The engagement groove 44 is formed so as to extend obliquely rearward (to the other end side) from an edge of the clamped portion 40.

Figure 6:
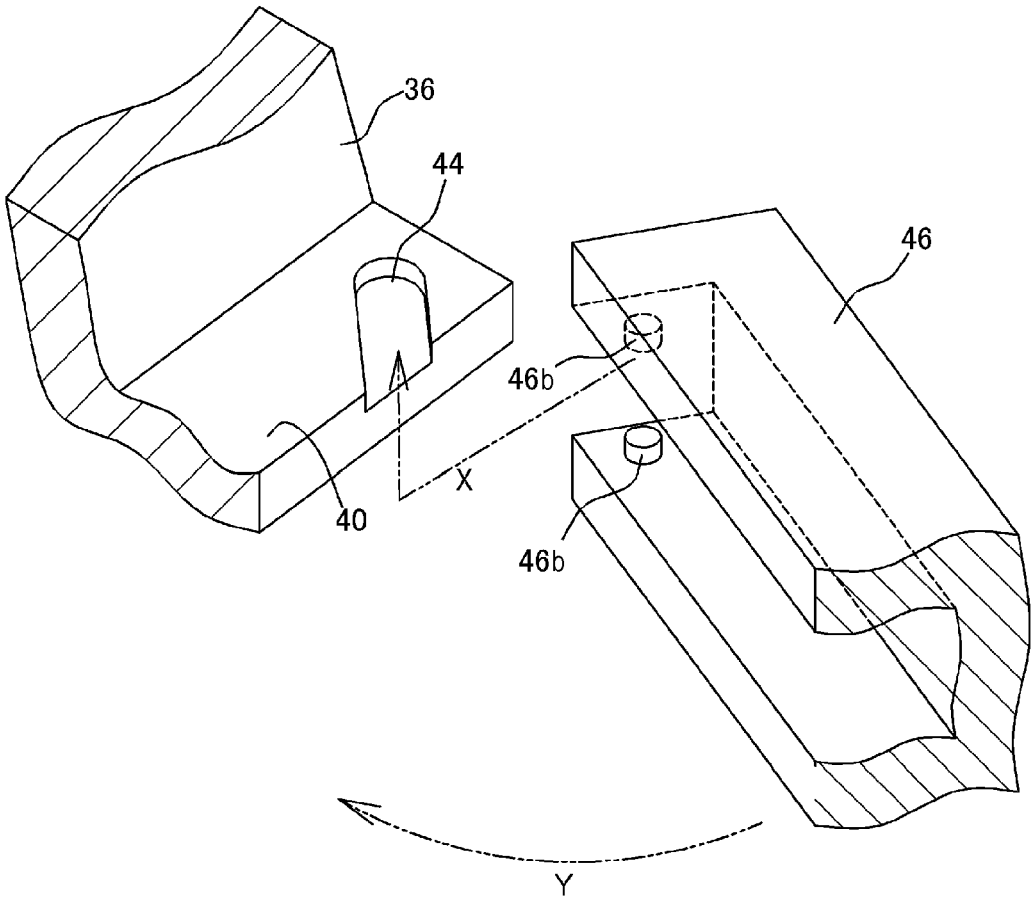
FIG. 6 is an explanatory diagram illustrating a way of fitting a sandwiching piece to a clamped portion when clamp joining outer cylinder components.
Figure 7:
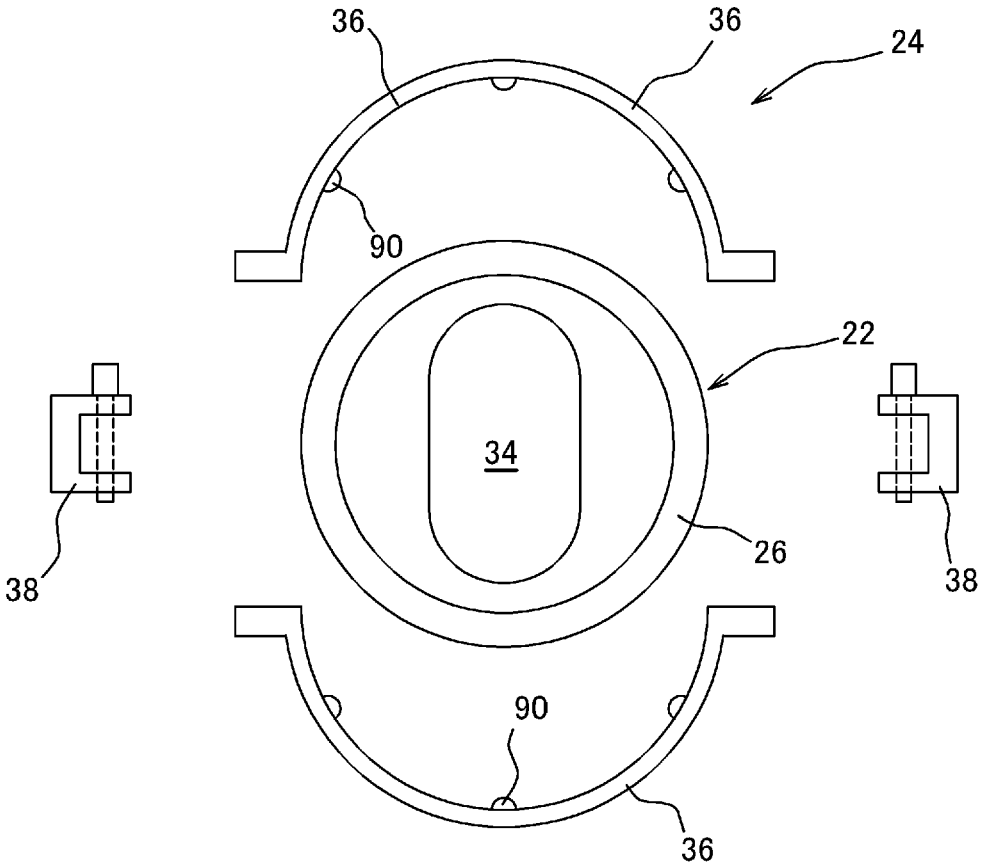
FIG. 7 is a front view illustrating an exploded state of a stator according to a modification of the embodiment of the invention.

The clamp 38 includes a sandwiching piece 46 having a substantially C-shaped cross-section, and a pin 48. When mounting the outer cylinder components 36 on the outer cylinder mounting portion 28, the sandwiching piece 46 is mounted so as to sandwich the clamped portions 40, 40 which are in an overlapping state. The sandwiching piece 46 has a length substantially equal to that of the clamped portion 40. On one longitudinal end side of the sandwiching piece, pin insertion holes 46*a* are formed, and protrusions 46*b* are provided on the other longitudinal end side thereof. In a state in which, as indicated by an arrow X of FIG. 6, each of the protrusions 46*b* is slid along the engagement groove 44 which is formed in the clamped portion 40 so as to extend obliquely, and each of the protrusions 46*b* abuts on an end portion of the engagement groove 44, the sandwiching piece 46 is pivoted about the protrusions 46*b* as indicated by an arrow Y of FIG. 6, with the result that it is possible to obtain a state in which the pin insertion holes 46*a* are communicated to the pin insertion holes 42, 42 on the flanges 40, 40 side. In this state, through insertion of the pin 48 through all the pin insertion holes 46*a*, 42, and 42, the flanges 40, 40 can be sandwiched and fixed (clamp joined) by the clamp 38.

The stator 20 is used in a state in which the liner portion 22 is covered with the outer cylinder components 36, 36 and the clamped portions 40, 40 are joined by the clamps 38, 38. The stator 20 is incorporated in a stator fixing portion 12*b* situated adjacent to the first opening 14*a* in the pump casing 12. Specifically, the stator 20 is fixed in such a manner that the flange portions 26, 26 provided at both ends of the liner portion 22 are inserted into the fitting portion 12*c* of the pump casing 12 and the fitting portion 13*b* of the end stud 13 to be sandwiched between the end stud 13 and the intermediate portion 12*a* (in the stator fixing portion 12*b*), and the stay bolt 18 is fitted and fastened across the end stud 13 and a main body part of the pump casing 12.

When the stator 20 is fixed in the above-mentioned manner, as illustrated in FIG. 2(*a*), one of the flange portions 26 is sandwiched between the end stud 13 and the outer cylinder portion 24 on one end side of the liner portion 22. Further, as illustrated in FIG. 2(*b*), on the other end side thereof, the other of the flange portions 26 is sandwiched between the intermediate portion 12*a* and the outer cylinder portion 24. In addition, the outer cylinder portion 24 abuts on the flange portion 26 and the end portion of the end stud 13 on one end side of the outer cylinder portion 24, and abuts on the flange portion 26 and the end portion of the pump casing 12 on the other end side thereof. Therefore, in the stator 20, positional shifts and the like of both of the liner portion 22 and the outer cylinder portion 24 do not occur in the stator fixing portion 12*b* of the pump casing 12.

As illustrated in FIG. 1, the rotor 50 is a metal shaft, and has a single-start, multi-stage, and eccentric external thread shape. The rotor 50 is formed to have a substantially complete round cross-sectional shape in cross-sectional view taken from any position in its longitudinal direction. The rotor 50 is inserted through the through-hole 34 formed in the above-mentioned stator 20, and can freely and eccentrically rotate inside the through-hole 34.

When the rotor 50 is inserted through the through-hole 34 formed in the liner portion 22 of the stator 20, an outer peripheral surface 52 of the rotor 50 and the inner peripheral surface 32 of the stator 20 abut on each other along tangent lines of both of the peripheral surfaces. Further, in this state, between the inner peripheral surface 32 of the stator 20 and the outer peripheral surface of the rotor 50, a fluid conveying passage 60 is formed.

The fluid conveying passage 60 extends in a spiral shape in the longitudinal direction of the stator 20 and the rotor 50. Further, when the rotor 50 is rotated inside the through-hole 34 of the stator 20, the fluid conveying passage 60 advances in the longitudinal direction of the stator 20 while rotating inside the stator 20. Therefore, when the rotor 50 is rotated, the fluid is sucked into the fluid conveying passage 60 from one end side of the stator 20, and the fluid is transferred to the other end side of the stator 20 while being confined inside the fluid conveying passage 60. In this manner, it is possible to discharge the fluid to the other end side of the stator 20. That is, when the rotor 50 is rotated in the forward direction, it is possible to transfer under pressure the fluid sucked from the second opening 14*b*, and to discharge the fluid from the first opening 14*a*. Further, when the rotor 50 is rotated in the reverse direction, it is possible to discharge from the second opening 14*b* the fluid sucked from the first opening 14*a*.

The power transmission mechanism 70 is provided so as to transmit power from a power source (not shown), such as a motor provided outside the pump casing 12, to the above-mentioned rotor 50. The power transmission mechanism 70 includes a power connecting portion 72 and an eccentric rotary portion 74. The power connecting portion 72 is provided in a shaft accommodating portion 12*c* provided on one longitudinal end side of the pump casing 12, more specifically, on the side (hereinafter, simply referred to as "proximal end side") opposite to the side on which the above-mentioned end stud 13 and the stator fixing portion 12*b* are provided. Further, the eccentric rotary portion 74 is provided in the intermediate portion 12*a* formed between the shaft accommodating portion 12*c* and the stator fixing portion 12*b*.

The power connecting portion 72 includes a drive shaft 76, and the drive shaft is supported by two bearings 78*a*, 78*b* so as to be freely rotatable. The drive shaft 76 sticks out of a closed part on the proximal end side of the pump casing 12, and is connected to the power source. Therefore, through activation of the power source, the drive shaft 76 can be rotated. Between the intermediate portion 12*a* and the shaft accommodating portion 12*c* in which the power connecting portion 72 is provided, a shaft sealing device 80 formed of, for example, a mechanical seal or a gland packing is provided. This provides the structure in which the fluid as an object to be conveyed does not leak from the intermediate portion 12*a* side to the shaft accommodating portion 12*c* side.

The eccentric rotary portion 74 connects between the above-mentioned drive shaft 76 and the rotor 50 so as to allow power transmission there between. The eccentric rotary portion 74 includes a coupling shaft 82 and two coupling bodies 84, 86. The coupling shaft 82 is formed of a conventionally-known coupling rod, screw rod, or the like. The coupling body 84 couples the coupling shaft 82 and the rotor 50 to each other, and the coupling body 86 couples the coupling shaft 82 and the drive shaft 76 to each other. The coupling bodies 84, 86 are both formed of a conventionally-known universal joint or the like. The coupling bodies 84, 86 can transmit to the rotor 50 rotational power transmitted through the drive shaft 76, to thereby rotate the rotor 50 eccentrically.

As described above, in the stator 20 of the uniaxial eccentric screw pump 10 according to this embodiment; the outer cylinder portion 24 is mounted in a non-bonded state on the liner portion 22 that is integrally formed. Specifically, due to an influence of a sandwiching force generated by mounting the clamp 38 on the clamped portions 40, 40 of the outer cylinder components 36, 36, a pressing force in a radially inward direction of the outer cylinder portion 24 acts on the liner portion 22. Due to the pressing force, the outer cylinder portion 24 is mounted in a pressed state on the outer periphery of the liner portion 22, and is positioned in the axial direction and the peripheral direction of the liner portion 22. Therefore, the uniaxial eccentric screw pump 10 enables the liner portion 22 and the outer cylinder portion 24 to be easily separated and recovered through dismounting of the outer cylinder components 36, 36 and the clamps 38, 38. Thus, it is possible to give due consideration to environmental issues.

Further, the uniaxial eccentric screw pump 10 has structure in which the outer cylinder portion 24 covers the outer cylinder mounting portion 28 that is present between the flange portions 26 provided at both the end portions of the liner portion 22, and that the end portions of the outer cylinder portion 24 abut on the flange portions 26. This structure can prevent the liner portion 22 from shrinking in the axial direction. That is, the outer cylinder portion 24 functions as a support for preventing the liner portion 22 from shrinking in the axial direction. This can keep an inner diameter of the liner portion 22 substantially uniform at any part even when a compression force in the axial direction acts on the stator 20 due to an influence of discharge pressure and the like. Thus, it is possible to avoid uneven wear of the liner portion 22, and to stabilize a discharge amount.

According to the uniaxial eccentric screw pump 10, the outer cylinder portion 24 can be divided into the plurality of outer cylinder components 36 in the peripheral direction, and hence it is possible to easily perform work of mounting/dismounting the outer cylinder portion 24 to/from the liner portion 22. Further, the above-mentioned outer cylinder portion 24 is an integrated member obtained by joining (clamp joining) the outer cylinder components 36 with each other using the clamps 38, and hence the outer cylinder portion 24 can be mounted/dismounted simply by mounting/dismounting the sandwiching pieces 46 and the pins 48 to/from the clamped portions 40, 40.

Note that, in this embodiment, an example of constituting the outer cylinder portion 24 by the two outer cylinder components 36 is exemplified, but the present invention is not limited thereto. Alternatively, the outer cylinder portion 24 may be formed of even more outer cylinder components 36. Further, in this embodiment, an example of joining the outer cylinder components 36, 36 together by the clamps 38 at two peripheral points is exemplified, but the present invention is not limited thereto. For example, there can be adopted structure in which one peripheral end side of the outer cylinder components 36, 36 is coupled by a hinge or the like, and the other peripheral end side thereof is coupled by the clamp 38 or another method. In addition, in this embodiment, an example of using the clamp 38 formed of the sandwiching piece 46 and the pin 48 in order to join the outer cylinder components 36, 36 together is exemplified, but the present invention is not limited thereto. As long as the outer cylinder components 36, 36 can be fixed so as not to be shifted in position, the outer cylinder components 36, 36 may be joined together using any other method.

According to the uniaxial eccentric screw pump 10 of this embodiment, the end stud 13 is arranged on one end side of the stator 20, and the stator 20 is integrally coupled to the pump casing 12 together with the end stud 13 using a fastening force generated by the stay bolt 18. Further, in the stator 20, the outer cylinder portion 24 abuts on the end portion 12*b* of the pump casing 12 and the end portion 13*a* of the end stud 13. Therefore, in a state in which the stator 20 is assembled, the fastening force generated by the stay bolt 18 acts more preferentially on the outer cylinder portion 24 than on the liner portion 22, and hence it is possible to prevent action of a large compression force in the axial direction on the liner portion 22, and compressive deformation of the liner portion 22. Further, this can prevent uneven wear of the liner portion 22, and stabilize the discharge amount.

According to the uniaxial eccentric screw pump 10 of this embodiment, at the end portion 12*b* of the pump casing 12 and the end portion 13*a* of the end stud 13, the fitting portions 12*c*, 13*b* for enabling the flange portions 26 to be fitted thereon are respectively provided. The flange portions 26 of the liner portion 22 fitted to the fitting portions are sandwiched between the outer cylinder portion 24 and the end stud 13 and between the outer cylinder portion 24 and the pump casing 12. This can reliably prevent a positional shift of the liner portion 22 in the axial direction, and can further stabilize an operation state of the uniaxial eccentric screw pump 10.

As described above, the outward shape of the outer cylinder mounting portion 28 of the liner portion 22 is polygonal (substantially decagonal in this embodiment). In addition, each of the outer cylinder components 36, 36 is bent into a shape conforming to the outer cylinder mounting portion 28. Through clamping and joining of the clamped portions 40 by the clamps 38, the outer cylinder portion 24 having a cylindrical shape and substantially the same shape (substantially regular decagonal shape in this embodiment) as that of the outer cylinder mounting portion 28 is formed. Thus, even when a load in the peripheral direction acts on the liner portion 22, it is possible to prevent only the liner portion 22 from being shifted in position in the peripheral direction, and to stabilize the operation state of the uniaxial eccentric screw pump 10.

Note that, in this embodiment, such an example is exemplified that, in order to prevent the liner portion 22 from being shifted in position with respect to the outer cylinder portion 24, each of the outer cylinder mounting portion 28 and the outer cylinder portion 24 is formed into a polygonal shape. However, in a case of adopting another configuration capable of preventing the positional shift in the peripheral direction, or in a case of requiring no consideration of the positional shift in the peripheral direction, a configuration different from the above-mentioned configuration may be adopted. Specifically, the outer cylinder mounting portion 28 and the outer cylinder portion 24 have substantially the same cross-sectional shape, but, for example, as in a configuration in which the outer cylinder mounting portion 28 is formed into a substantially regular decagonal shape and the outer cylinder portion 24 is formed into a substantially regular dodecagonal shape, the cross-sectional shapes of both the portions may be different from each other as long as the outer cylinder mounting portion 28 and the outer cylinder portion 24 function to prevent turning of the liner portion 22.

Further, there may be adopted a configuration in which protrusions 90 are provided on an inner peripheral side of the outer cylinder portion 24 and, through mounting of the outer cylinder portion 24 on the outer cylinder mounting portion 28, the above-mentioned protrusions 90 are held in press-contact with an outer peripheral surface of the liner portion 22. With this configuration, the protrusions 90 are caught on the outer peripheral surface of the liner portion 22, and hence it is possible to prevent the liner portion 22 from being shifted in position in the peripheral direction and the axial direction. The configuration in which the protrusions 90 are provided in this manner is effective not only in a case where the outer cylinder mounting portion 28 and the outer cylinder portion 24 are each formed into a polygonal shape as in this embodiment, but also in a case where there is a fear of the positional shift of the liner portion 22 as in a case where the outward shape of the liner portion 22 is cylindrical.

What is claimed is:

1. An uniaxial eccentric screw pump, comprising:

a rotor of an external thread type; and a stator enabling the rotor to be inserted therethrough, the stator comprising:

a liner portion having a prism shape and being integrally formed so as to have an inner peripheral surface of an internal thread type;

an outer portion removably mounted in a pressed state on an outer periphery of the liner portion, the outer portion covering the liner portion entirely in a peripheral direction, applying pressure in a radially inward direction along an entire length of the liner portion;

the liner portion comprising, at both end portions thereof, collar portions protruding radially outward, the outer portion being arranged between the collar portions, and end portions of the outer portion abutting on the collar portions, respectively, and providing support for the liner portion against shrinking in an axial direction.

2. An uniaxial eccentric screw pump, comprising:

a rotor of an external thread type; and a stator enabling the rotor to be inserted therethrough, the stator comprising:

a liner portion having a prism shape and being integrally formed so as to have an inner peripheral surface of an internal thread type; and an outer portion removably mounted, in a non-bonded state, on the liner portion to cover an outer periphery of the liner portion, the outer portion having longitudinal portions that are held against each other by at least one clamp, the clamp fixing the longitudinal portions in a position to be immovable;

the liner portion comprising, at both end portions thereof, collar portions protruding radially outward, the outer portion being arranged between the collar portions, and end portions of the outer portion abutting on the collar portions, respectively.

3. The uniaxial eccentric screw pump of claim 1, wherein the outer portion is capable of being divided into a plurality of outer components in a peripheral direction thereof.

4. The uniaxial eccentric screw pump of claim 1, further comprising:

an end stud arranged on one end side of the stator, wherein the end stud and an end portion of a pump casing connecting to another end side of the stator are coupled and fastened by a screw rod so that the stator is integrally coupled to the pump casing together with the end stud, and wherein the end portions of the outer portion abut on the end stud and the end portion of the pump casing, respectively.

5. The uniaxial eccentric screw pump of claim 4, further comprising:

a fitting portion enabling at least one of the collar portions to be fitted thereto, the fitting portion being provided at the end stud and/or the end portion of the pump casing, wherein, at the fitting portion, the at least one of the collar portions is sandwiched between the end stud and the outer portion and/or between the pump casing and the outer portion.

6. The uniaxial eccentric screw pump according to claim 1, wherein a cross section of the liner portion is a polygonal shape.

7. The uniaxial eccentric screw pump of claim 6, wherein the outer portion is bent into a shape conforming to the polygonal shape of the cross section of the liner portion.

8. The uniaxial eccentric screw pump of claim 1, further comprising:

at least one protrusion provided on an inner peripheral side of the outer portion, wherein the protrusion is held in press-contact with an outer peripheral surface of the liner portion.

9. The uniaxial eccentric screw pump of claim 8, wherein the at least one protrusion comprises a plurality of protrusions, the protrusions being distributed on the inner peripheral side of the outer portion at least in a peripheral direction.

10. The uniaxial eccentric screw pump of claim 2, wherein the at least one clamp has a c-shaped cross-section.

11. The uniaxial eccentric screw pump of claim 2, wherein the longitudinal portions of the outer portion comprise insertion holes and the at least one clamp comprises insertion holes, the insertion holes of the longitudinal portions and the at least one clamp are aligned with each other to receive at least one pin for clamping the outer portion on the liner portion.

12. An uniaxial eccentric screw pump, comprising:

a rotor of an external thread type; and a stator enabling the rotor to be inserted therethrough, the stator comprising:

a liner portion having a prism shape and being integrally formed so as to have an inner peripheral surface of an internal thread type; and an outer portion removably mounted, in a non-bonded state, on the liner portion to cover an outer periphery of the liner portion, the outer portion having longitudinal portions that are joinable by at least one clamp, the clamp being immovably fixed to the longitudinal portions in a position for clamping the outer portion on the liner portion;

the liner portion comprising, at both end portions thereof, collar portions protruding radially outward, the outer portion being arranged between the collar portions, and end portions of the outer portion abutting on the collar portions, respectively;

wherein the longitudinal portions of the outer portion comprise insertion holes and the at least one clamp comprises insertion holes, the insertion holes of the longitudinal portions and the at least one clamp are aligned with each other to receive at least one pin for clamping the outer portion on the liner portion.

13. The uniaxial eccentric screw pump of claim 12, wherein the longitudinal portions have engagement grooves to guide the at least one clamp into the position for clamping the outer portion on the liner portion.

14. The uniaxial eccentric screw pump of claim 13, wherein the engagement grooves are disposed proximate to one end of the outer portion and the insertion holes of the of the outer portion are disposed proximate to the other end of the outer portion opposite the engagement grooves.

15. The uniaxial eccentric screw pump of claim 13, wherein the at least one clamp comprises protrusions adapted to slide into the engagement grooves in the longitudinal portions, the protrusions providing the at least one clamp to be pivotable relative to the longitudinal portions into the position for clamping the outer portion on the liner portion.

* * * * *